US008079604B2

(12) United States Patent
Newton

(10) Patent No.: US 8,079,604 B2
(45) Date of Patent: Dec. 20, 2011

(54) SKATEBOARD PROVIDING SUBSTANTIAL FREEDOM OF MOVEMENT OF THE FRONT TRUCK ASSEMBLY

(75) Inventor: Colin O. Newton, Laguna Beach, CA (US)

(73) Assignee: SurfSkate Industries, LLC, Weston, FL (US)

( * ) Notice: Subject to any disclaimer, the term of this patent is extended or adjusted under 35 U.S.C. 154(b) by 260 days.

(21) Appl. No.: 12/473,695

(22) Filed: May 28, 2009

(65) Prior Publication Data

US 2010/0301572 A1 Dec. 2, 2010

(51) Int. Cl.
*A63C 17/02* (2006.01)

(52) U.S. Cl. ..... 280/11.27; 280/87.03; 280/47.12; 280/11.23

(58) Field of Classification Search ..... 280/11.223, 280/11.27, 11.23, 11.26, 87.03, 87.041–43, 280/87.029, 47.12, 47.15, 11.19, 809; 301/125
See application file for complete search history.

(56) References Cited

U.S. PATENT DOCUMENTS

| | | | |
|---|---|---|---|
| 244,372 | A | 7/1881 | Bliss |
| 565,718 | A | 8/1896 | Boardman |
| 1,269,107 | A | 6/1918 | Moomaw |
| 1,467,453 | A | 9/1923 | Remacle |
| 1,809,609 | A | 6/1931 | Turner |
| 2,114,586 | A | 4/1938 | Bowen |
| 2,424,072 | A | 7/1947 | Allred |
| 2,542,829 | A | 2/1951 | Murray |
| 2,632,652 | A | 3/1953 | Wintercorn |
| 3,235,282 | A | 2/1966 | Bostick |
| 3,505,878 | A | 4/1970 | Moll |
| 3,649,038 | A | 3/1972 | Huckenbeck |
| 3,771,811 | A | 11/1973 | Bueno |
| 4,061,350 | A | 12/1977 | Schmidt, Jr. et al. |

(Continued)

FOREIGN PATENT DOCUMENTS

| | | |
|---|---|---|
| DE | 29518632 | 1/1996 |

(Continued)

OTHER PUBLICATIONS

International Search Report and Written Opinion, for PCT/US2010/026069 filed on Mar. 3, 2010, report mailed on Jan. 19, 2011, 19 pages.

(Continued)

*Primary Examiner* — J. Allen Shriver, II
*Assistant Examiner* — James Triggs
(74) *Attorney, Agent, or Firm* — Gesmer Updegrove LLP

(57) ABSTRACT

A skateboard is disclosed that includes a rear wheel system and a front wheel system. The rear wheel system includes a pair of rear wheels that are mounted on a rear axle that is coupled to a rear truck that is attached to an underside of a rear portion of a board. The rear wheel system permits each of the pair of rear wheels to alternately move toward a front portion of the board responsive to a force alternately urging each of the pair of rear wheels toward the underside of the board. The front wheel system includes a pair of front wheels that are mounted on a front axle that is rotatably attached to a mid-truck such that the front axle is movable about a first axis of rotation. The mid-truck is rotatably attached to an attachment base that is secured to an underside of the front portion of the board such that the mid-truck is rotatable about a second axis of rotation. The movement of the front axle about the first axis and the rotation of the mid-truck about the second axis provides that each of the pair of front wheels maintains substantially equal force against the ground during turning even when the rear truck is stationary with respect to the ground.

26 Claims, 11 Drawing Sheets

U.S. PATENT DOCUMENTS

| | | | | |
|---|---|---|---|---|
| 4,071,256 | A | 1/1978 | Kimmell | |
| 4,076,265 | A * | 2/1978 | Eash, II | 280/87.042 |
| 4,109,925 | A | 8/1978 | Williams et al. | |
| 4,114,232 | A * | 9/1978 | Umeda | 16/35 R |
| 4,159,830 | A * | 7/1979 | Solimine | 280/11.28 |
| 4,166,629 | A | 9/1979 | List | |
| 4,168,842 | A | 9/1979 | Kimmell et al. | |
| 4,176,850 | A | 12/1979 | Johnson | |
| 4,202,558 | A * | 5/1980 | Olschewski et al. | 280/11.28 |
| 4,202,559 | A * | 5/1980 | Piazza, Jr. | 280/87.042 |
| 4,645,223 | A | 2/1987 | Grossman | |
| 4,775,162 | A | 10/1988 | Chao | |
| 4,776,604 | A | 10/1988 | Valdez et al. | |
| 4,930,794 | A * | 6/1990 | Chan | 280/11.28 |
| 4,955,626 | A * | 9/1990 | Smith et al. | 280/87.042 |
| 5,029,887 | A * | 7/1991 | Grutzner et al. | 280/242.1 |
| 5,052,702 | A | 10/1991 | Chan | |
| 5,236,208 | A * | 8/1993 | Welsh | 280/87.041 |
| 5,263,725 | A | 11/1993 | Gesmer et al. | |
| 5,292,141 | A * | 3/1994 | Ekedal et al. | 280/87.042 |
| 5,347,681 | A * | 9/1994 | Wattron et al. | 16/30 |
| 5,372,384 | A | 12/1994 | Smith | |
| 5,409,265 | A * | 4/1995 | Douglass | 280/843 |
| 5,505,474 | A * | 4/1996 | Yeh | 280/87.042 |
| 5,522,620 | A * | 6/1996 | Pracas | 280/87.041 |
| 5,540,455 | A * | 7/1996 | Chambers | 280/87.042 |
| 5,613,695 | A * | 3/1997 | Yu | 280/14.25 |
| 5,833,252 | A | 11/1998 | Strand | |
| 5,868,408 | A | 2/1999 | Miller | |
| 5,879,013 | A * | 3/1999 | Shih | 280/11.28 |
| 5,915,707 | A * | 6/1999 | Steffen | 280/87.03 |
| 5,992,865 | A * | 11/1999 | Vargas | 280/87.042 |
| 6,105,978 | A * | 8/2000 | Vuerchoz | 280/11.27 |
| 6,193,249 | B1 * | 2/2001 | Buscaglia | 280/87.042 |
| 6,206,389 | B1 * | 3/2001 | Yagi | 280/87.042 |
| 6,257,614 | B1 * | 7/2001 | Duggan | 280/618 |
| 6,267,394 | B1 * | 7/2001 | Bouden | 280/87.042 |
| 6,270,096 | B1 * | 8/2001 | Cook | 280/87.042 |
| 6,298,952 | B1 * | 10/2001 | Tsai | 188/29 |
| 6,318,739 | B1 | 11/2001 | Fehn, Jr. | |
| 6,398,238 | B1 * | 6/2002 | Shaw | 280/87.042 |
| 6,419,249 | B1 * | 7/2002 | Chen | 280/87.042 |
| 6,428,022 | B1 * | 8/2002 | Namiki | 280/87.042 |
| 6,428,023 | B2 | 8/2002 | Reyes et al. | |
| 6,467,782 | B1 | 10/2002 | Smith | |
| 6,488,295 | B1 * | 12/2002 | Bryant | 280/87.042 |
| 6,547,262 | B1 | 4/2003 | Yamada et al. | |
| 6,793,224 | B2 * | 9/2004 | Stratton | 280/87.042 |
| 7,080,845 | B2 | 7/2006 | Inchley | |
| 7,121,566 | B2 | 10/2006 | McClain | |
| 7,195,259 | B2 * | 3/2007 | Gang | 280/87.042 |
| 7,237,784 | B1 * | 7/2007 | Monteleone | 280/87.042 |
| 7,243,925 | B2 * | 7/2007 | Lukoszek | 280/11.28 |
| 7,287,762 | B2 | 10/2007 | Stratton | |
| 7,438,303 | B2 | 10/2008 | Cole | |
| 7,464,951 | B2 * | 12/2008 | Coray | 280/282 |
| 7,600,768 | B2 * | 10/2009 | Chen et al. | 280/87.042 |
| 7,766,351 | B2 * | 8/2010 | Chen et al. | 280/87.042 |
| 7,775,534 | B2 * | 8/2010 | Chen et al. | 280/87.042 |
| 7,784,833 | B2 * | 8/2010 | Tsuchie | 280/842 |
| 7,891,680 | B2 * | 2/2011 | Chen et al. | 280/87.042 |
| 2002/0067015 | A1 | 6/2002 | Tierney et al. | |
| 2002/0084602 | A1 * | 7/2002 | Feng | 280/11.223 |
| 2002/0163144 | A1 * | 11/2002 | Guerra | 280/11.27 |
| 2003/0098555 | A1 * | 5/2003 | Chen | 280/11.223 |
| 2005/0127629 | A1 | 6/2005 | Nelson et al. | |
| 2007/0114743 | A1 | 5/2007 | Chen | |
| 2009/0045598 | A1 | 2/2009 | Lee | |
| 2009/0250891 | A1 | 10/2009 | Stratton | |

FOREIGN PATENT DOCUMENTS

| | | | |
|---|---|---|---|
| EP | 557872 | A1 | 9/1993 |
| GB | 2186501 | | 8/1987 |
| WO | WO2004/014499 | | 2/2004 |
| WO | 2004020059 | A1 | 3/2004 |
| WO | WO2007117125 | | 10/2007 |
| WO | WO2010019627 | | 2/2010 |

OTHER PUBLICATIONS

Partial International Search Report, for PCT/US2010/026069, mailed on Nov. 10, 2010, 2 pages.

"Quad Roller Skate Trucks" <http://www.quadskating.com/skates/roller-skate-trucks.htm>, Aug. 11, 2007.

"Skateboard Trucks" <http://www.skatesonhaight.com/ProductDetails.asp?ProductCode=TTRTX>, Aug. 11, 2007.

* cited by examiner

SKATEBOARD PROVIDING SUBSTANTIAL FREEDOM OF MOVEMENT OF THE FRONT TRUCK ASSEMBLY

BACKGROUND

The invention generally relates to skateboards, and relates in particular to truck assemblies on skateboards.

Skateboard truck assemblies generally include the skateboard wheels, axle and mounting hardware the attaches the wheels and axle to the underside of a skateboard. The principle by which most conventional skateboards steer was developed long ago in connection with roller skates (see, for example, U.S. Pat. No. 244,372, which discloses roller skates having wheel assemblies that face one another and further provide that each axle is permitted to move in a limited arc. Such an assembly provides that when pressure (a rider's weight) is applied to one side of the skate or board, the wheels on that same side move both closer to the board and closer toward each other, while the wheels on the opposite side of the skater or board mover further from the board and further from each other. In short, bringing the wheels closer together on one side facilitates turning on that side.

As shown in FIGS. 1 and 2 for example, a conventional skateboard includes a board 10 a front truck assembly 12 and a rear truck assembly 14. The front truck assembly 12 includes a pair of front wheels 16 and 18 that are mounted on a front axle 20. The front axle 20 is coupled to a base 22 that is attached to the underside of the board 10 and provides that the front wheels may generally move along a plane as shown at 21. The rear truck assembly 14 includes a pair of rear wheels 24 and 26 that are mounted on a rear axle 28. The rear axle 28 is coupled to a base 30 that is also attached to the underside of the board 10 and provides that the rear wheels may generally move along a plane as shown at 29.

The skateboard includes opposing elongated sides 32 and 34, and when a rider applies more force onto one side of the board, e.g., side 32 as shown in FIG. 2, then the wheel base distance between the front and back wheels 18 and 26 ($b_1$) on the side 32 is smaller than the wheel base distance between the front and back wheels 18 and 26 ($b_2$) on the side 34 as shown. This provides that the skateboard will turn in a direction associated with the side indicated at 32 due to the wheels on that side being closer together. The turning radius of such a skateboard, however, is generally rather large.

Other conventional skateboards also provide either insufficient freedom of movement or are not sufficiently stable. Published PCT Patent Application WO 2004/020059 discloses a truck assembly for a skateboard that permits the range of movement of the front truck to be adjusted. European Patent Application EP0557872 discloses a skateboard truck that is disclosed to provide improved axle rebound, in part, through the use of coil springs. U.S. Pat. No. 7,438,303 discloses a truck system that is disclosed to provide adjustment of the skateboard deck relative to the skateboard truck. U.S. Patent Application Publication No 2007/0114743 discloses skateboards that are disclosed to achieve forward propulsion from sideways movement. U.S. Pat. No. 4,930,794 discloses a skateboard toy that is disclosed to have a minimal number of parts, and is disclose to imitate turning of a "real skateboard" (col. 1, line 14) by providing that tilting of the board causes each wheel assembly to turn a small amount within limit walls. U.S. Patent Application Publication No. 2002/0067015 discloses a steerable in-line skateboard that includes forward and rear trucks that each include one wheel, and each wheel is mounted on a wheel support that rotates with respect to the board.

Each of these skateboards, however, does not provide sufficient freedom of movement (such as for example, may be required to imitate the feel of surfing on a water surfboard), while also providing a stable skateboard that is easy to use.

There remains a need therefore, for a skateboard that provides greater freedom of movement of the skateboard, and in particular for a skateboard that provides greater freedom of movement of its front wheel system yet is stable and easy to use.

SUMMARY OF THE INVENTION

It is an object of the present invention to provide a skateboard that captures the feel of a water surfboard, and in particular that may pivot from the rear (e.g., as provided by a skeg on a surfboard) while permitting the direction of the front of the board to be freely moved with excellent stability.

It is also an object of the present invention to provide a skateboard that may be turned either with or without tilting one side of the board closer to the ground when riding.

It is also an object of the present invention to provide a skateboard that may be moved forward by a rider from a dead stop without pushing off of the ground.

It is also an object of the present invention to provide a skateboard that provides a wide range of dynamic movements of the front end of the skateboard while also providing consistent traction on the ground surface.

In accordance with an embodiment, the invention provides a skateboard that includes a rear wheel system and a front wheel system. The rear wheel system includes a pair of rear wheels that are mounted on a rear axle that is coupled to a rear truck that is attached to an underside of a rear portion of a board. The rear wheel system permits each of the pair of rear wheels to alternately move toward a front portion of the board responsive to a force alternately urging each of the pair of rear wheels toward the underside of the board. The front wheel system includes a pair of front wheels that are mounted on a front axle that is rotatably attached to a mid-truck such that the front axle is movable about a first axis of rotation. The mid-truck is rotatably attached to an attachment base that is secured to an underside of the front portion of the board such that the mid-truck is rotatable about a second axis of rotation. The movement of the front axle about the first axis and the rotation of the mid-trick about the second axis provides that each of the pair of front wheels maintains substantially equal force against the ground during turning even when the rear truck is stationary with respect to the ground.

In accordance with another embodiment, the invention provides a skateboard that includes a board, a rear wheel system and a front wheel system. The rear wheel system includes a pair of rear wheels that are mounted on either side of a rear truck base that is attached to an underside of the board. The rear truck base includes a rear pivot assembly that permits each of the pair of rear wheels to alternately and oppositely move either forward with respect to the rear truck base and closer to the board, or rearward of the rear truck base and further from the board generally along a rear pivot plane. The front wheel system includes a pair of front wheels that are mounted on either side of a front mid-truck that is attached to the underside of the board by an attachment base that permits the front mid-truck together with the pair of front wheels to rotate in a full circle with respect to the attachment base about an axis of rotation such that the front wheels may rotate about the axis of rotation responsive to forces applied to the board to ensure that the wheels evenly distribute between them the force against the ground.

In accordance with another embodiment, the front wheel system includes a pair of front wheels that are mounted on either side of a front mid-truck that is attached to the underside of the board via a rotating attachment base, and the front wheel system further provides that each of the pair of front wheels is mounted for movement alternately either closer to or further away from the underside of the board and that the attachment base permits the front mid-truck to rotate together in a full circle with respect to the attachment base.

In accordance with a further embodiment, the invention provides a method of using a skateboard, and includes the steps of applying force to a first side of a skateboard, permitting a first of a pair of rear wheels to move forward with respect to a rear truck base and closer to the skateboard on the first side of the skateboard, and permitting a second of the pair of rear wheels to be moved rearward with respect to a rear truck base and further from the skateboard on an opposite second side of the skateboard. The method also includes the steps of permitting a first of a pair of front wheels to move forward with respect to a front truck base and closer to the skateboard on the first side of the skateboard, and permitting a second of the pair of front wheels to be moved rearward with respect to the front truck base and further from the skateboard on an opposite second side of the skateboard. The method further includes the step of permitting the front mid-truck to rotate with respect to the skateboard while the skateboard is turning toward the first side.

BRIEF DESCRIPTION OF THE ILLUSTRATED EMBODIMENTS

The following description may be further understood with reference to the accompanying drawings in which.

Figure 1:
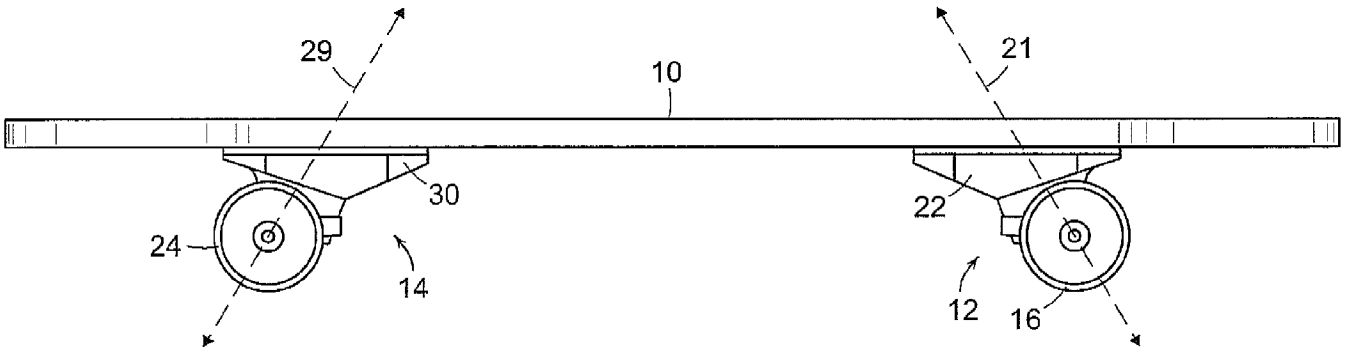
FIG. 1 PRIOR ART
FIG. 1 shows an illustrative diagrammatic side view of a skateboard of the prior art.
Figure 2:
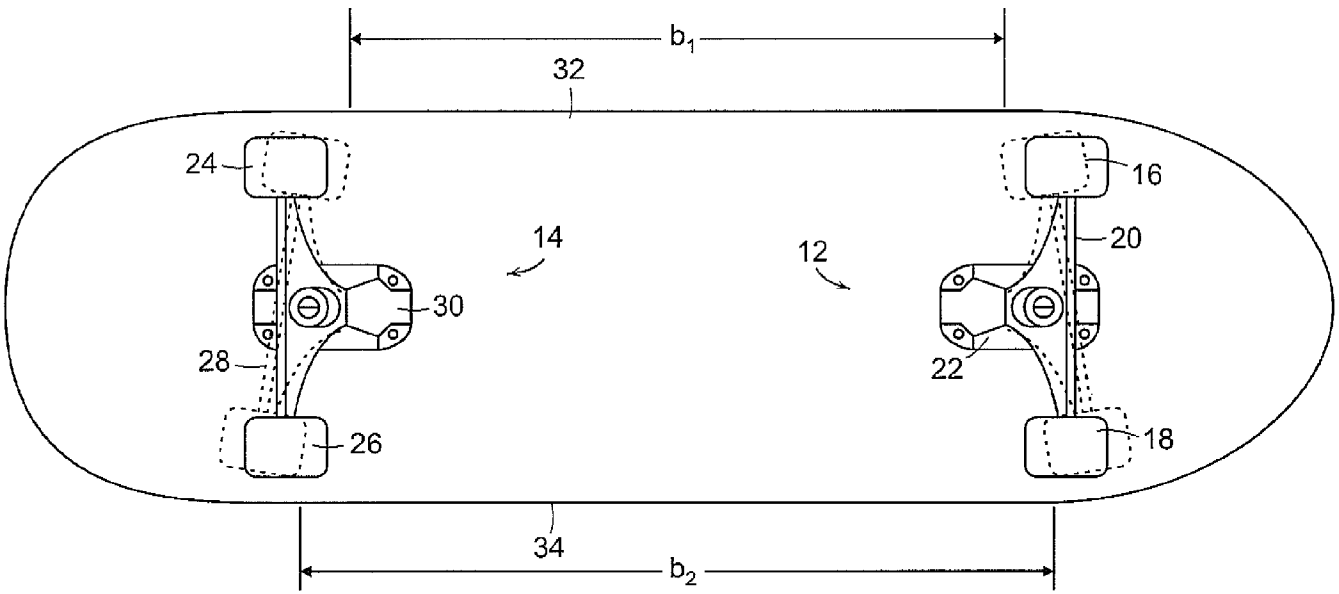
FIG. 2 PRIOR ART
FIG. 2 shows an illustrative diagrammatic bottom view of the skateboard of FIG. 1.
Figure 3A:
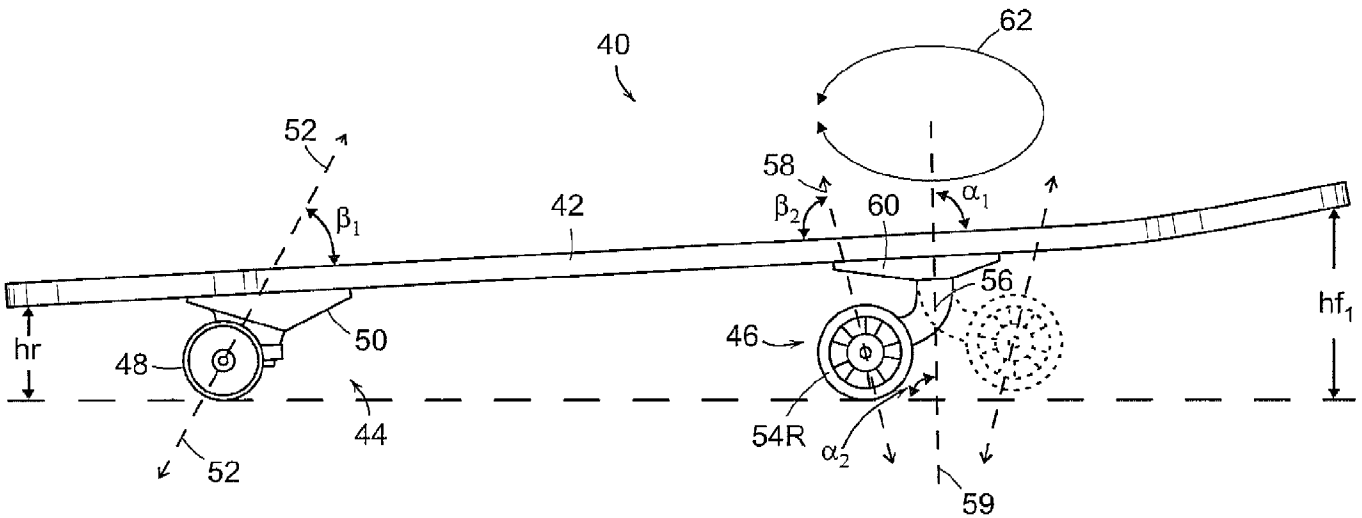
FIGS. 3A and 3B show illustrative diagrammatic side views of skateboards in accordance with an embodiment of the invention showing no rotation (FIG. 3A) and 180 degree rotation (FIG. 3B) of a portion of the front wheel assembly with respect to the skateboard.
Figure 3B:
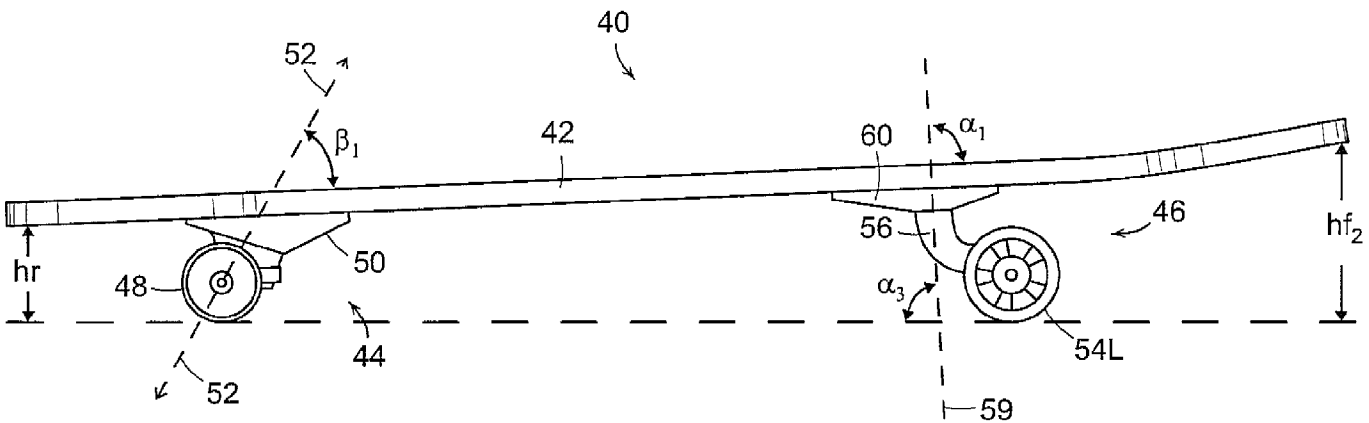
Figure 13:
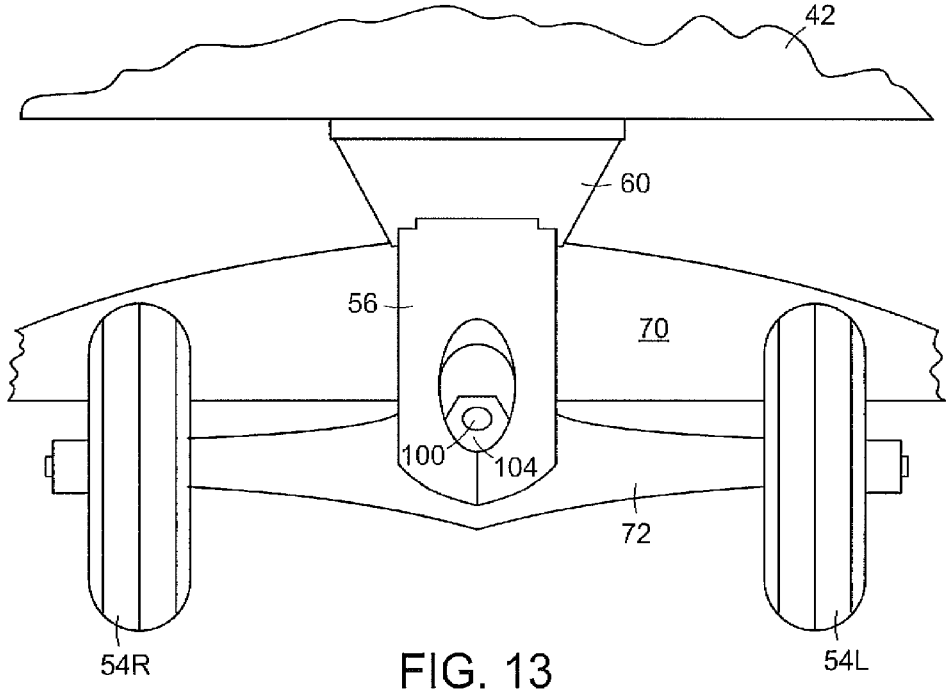
Figure 14A:
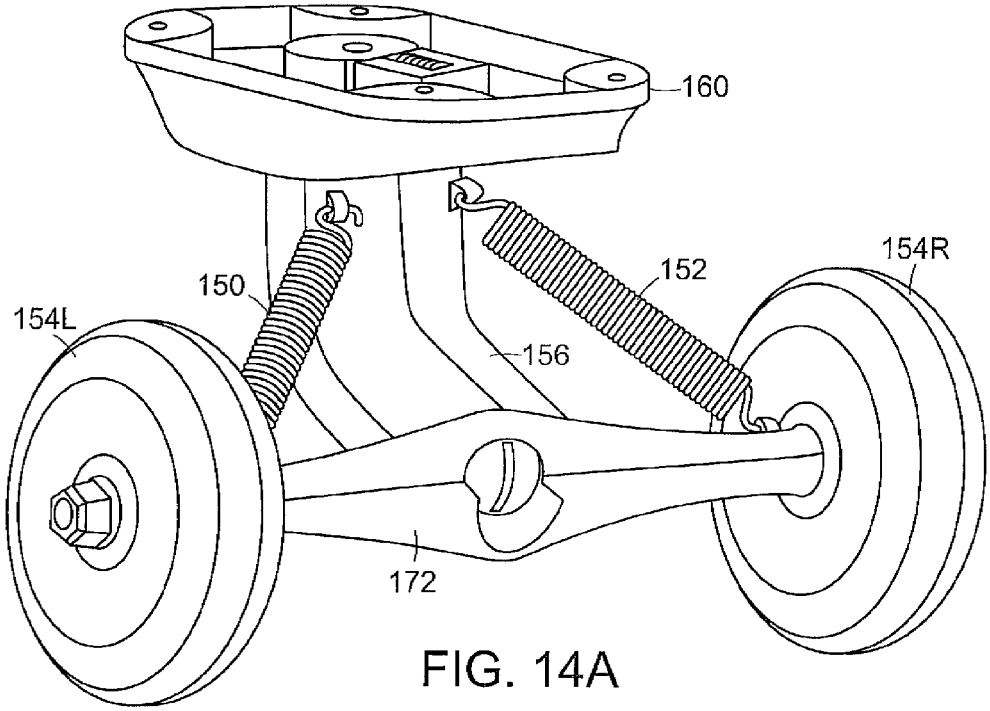
Figure 14B:
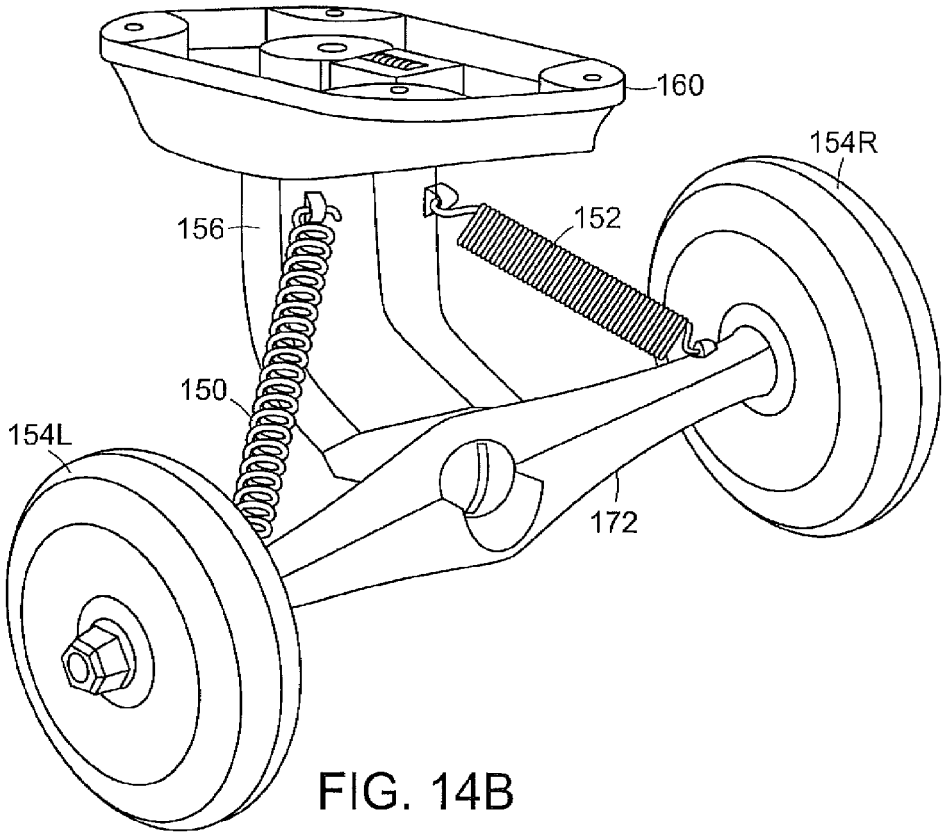

FIG. 13 shows an illustrative diagrammatic front view of the front wheel assembly of FIGS. 3A and 3B; and FIGS. 14A and 14B show illustrative diagrammatic isometric views of the front wheel assembly of the skateboard of a further embodiment of the invention without any rotational movement of the axle with respect to the mid-truck (FIG. 14A) and with movement of the axle with respect to the mid-truck (FIG. 14B).

The drawings are shown for illustrative purposes only.

DETAILED DESCRIPTION

Skateboards in accordance with various embodiments of the invention provide substantial freedom of movement of the front wheel assembly such that a rider of the skateboard may enjoy a sensation that is very similar to the sensation provided by water surfing on a surfboard.

In particular, skateboards of the present invention capture the feel of a water surfboard by permitting pivoting from the rear while also permitting the direction of the front to be freely moved with excellent stability either with or without tilting of the board.

As shown in FIG. 3A, a skateboard 40 in accordance with an embodiment of the invention includes a board 42, a rear wheel assembly 44 and a front wheel assembly 46. The rear wheel assembly 44 includes a pair of rear wheels 48 and a rear truck base 50 that is attached to the underside of the board 42. An axle on which each wheel of the pair of rear wheels 48 is mounted is pivotally coupled to the rear truck base such that each of the rear wheels is permitted to alternately and oppositely move in a direction that is either forward with respect to the rear truck base 50 and closer to the board 42, or rearward of the rear truck base 50 and further from the board 42 generally along a rear pivot plane as shown at 52.

The front wheel assembly 46 includes a pair of left and right front wheels 54L and 54R and a front axle on which each wheel of the pair of front wheels 54L and 54R is mounted is pivotally coupled to a front mid-truck 56 such that the each of the front wheels is permitted to alternately and oppositely move in a direction that is either forward with respect to the front mid-truck 56 and closer to the board 42, or rearward of the front mid-truck 56 and further from the board 42 generally along a rear pivot plane as shown at 58.

The front wheel assembly 46 also includes an attachment base 60 to which the front mid-truck 56 is rotatably attached, providing 360 degree rotation of the front mid-truck 56 with respect to the attachment base 60 as generally shown at 62. The axis of rotation 59 of the front mid-truck 56 may be generally perpendicular with respect to the board 42 as shown at a, in FIG. 3A. The height of the front end of the skateboard 40 ($h_f$) may also be greater than (higher off of the ground) than the height ($h_{r1}$) of the rear end of the skateboard 40 as shown. This is due to the fact that the front portion of the skateboard is further from the center of each of the front wheels than the rear portion of the skateboard is from the center of each of the rear wheels.

As shown in FIG. 3B, when the mid-truck 56 rotates 180 degrees about the axis 59, the height of the front end of the front portion of the board changes to a height $h_{f2}$ that is smaller than $h_{f1}$ but is still larger than hr. All rotational positions of the mid-truck 56 about the axis 59 will provide that the front end have a height off the ground that is between $h_{f1}$ and $h_{f2}$.

The rear wheel assembly 44 includes a pair of left and right rear wheels 48L and 48R and a rear truck base 50 that is attached to the underside of the board 42. An axle on which each wheel of the pair of rear wheels 48L and 48R is pivotally coupled to the rear truck base such that each of the rear wheels is permitted to alternately and oppositely move in a direction that is either forward with respect to the rear truck base 50 and closer to the board 42, or rearward of the rear truck base 50 and further from the board 42 generally along a rear pivot plane as shown at 52.

Figure 4A:
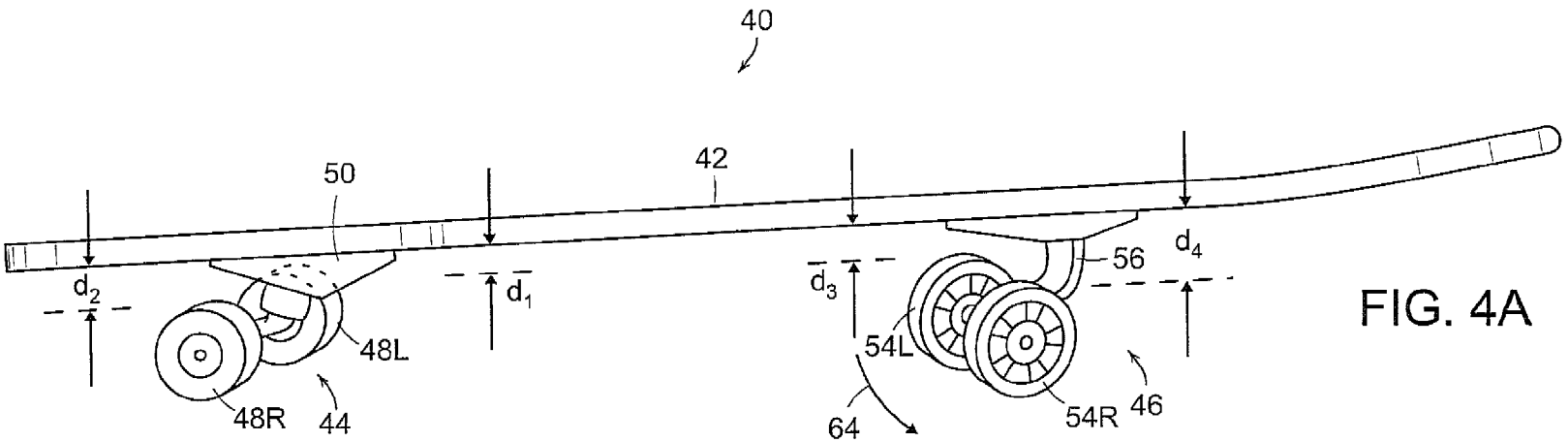
FIGS. 4A and 4B show illustrative diagrammatic side views of the skateboard of FIGS. 3A and 3B while turning left and right respectively with tilting of the board.

As shown in FIG. 4A, for example, when pressure is applied to the left side of the skateboard 40 to turn left, the left side rear wheel 48L moves forward of the rear truck base 50 and closer to the board 42, while the right side rear wheel 48R moves rearward of the rear truck base 50 and further from the board 42. In particular, the distance $d_1$ from the left rear wheel 48L to the board 42 is less than the distance $d_2$ from the right rear wheel 48R to the board 42. Similarly, the distance $d_3$ from the left front wheel 54L to the board 42 is less than the distance 44 from the right front wheel 54R to the board 42. At the same time however, the pair of wheels 54L and 54R both move together as shown at 64.

Figure 4B:
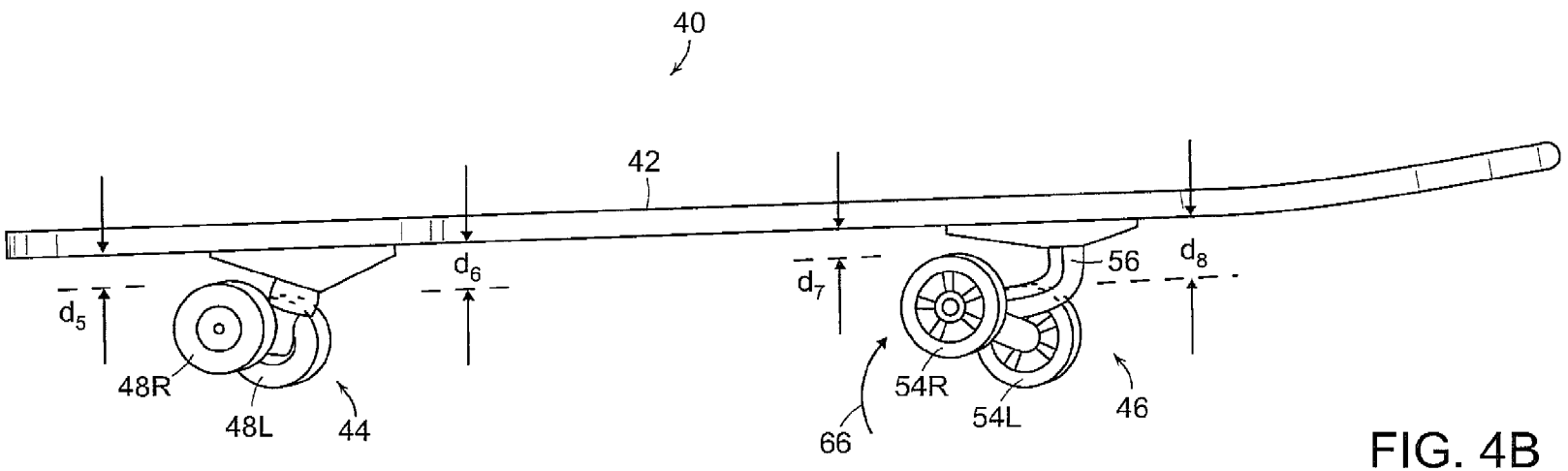

As shown in FIG. 4B, when pressure is applied to the right side of the skateboard 40 to turn right, the right side rear wheel 48R moves forward of the rear truck base 50 and closer to the board 42, while the left side rear wheel 48L moves rearward of the rear truck base 50 and further from the board 42. In particular, the distance $d_5$ from the right rear wheel 48R to the board 42 is less than the distance $d_6$ from the left rear wheel 48L to the board 42. Similarly, the distance $d_7$ from the right front wheel 54R to the board 42 is less than the distance $d_8$ from the left front wheel 54L to the board 42. At the same time, the pair of front wheels 54L and 54R both move together as shown at 66.

Figure 5A:
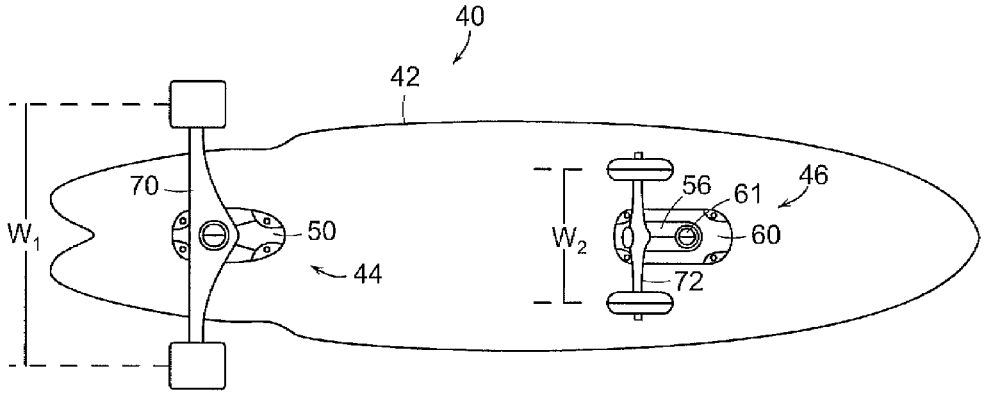
FIGS. 5A, 5B and 5C show illustrative diagrammatic bottom views of the skateboard of FIGS. 3A and 3B while not turning (FIG. 5A), turning right in accordance with an embodiment of the invention with tilting of the board (FIG. 5B), and turning right in accordance with another embodiment of the invention (FIG. 5C) without tilting of the board.

As shown in FIG. 5A, the rear wheels of the rear wheel assembly 44 are mounted on a rear axle 70, and the front wheels of the front wheel assembly 46 are mounted on a front axle 72. The track width of the rear wheels ($w_1$) is greater than (e.g., approximately twice the width of) the track width of the front wheels ($w_2$). This provides both increased stability yet also permits the turning radius of the rear wheel assembly to be smaller than with conventional skateboard truck assemblies. The dynamic movement of permitting the front pair of wheels 54 to move alternately and oppositely along the plane shown at 58 (in FIG. 3A) while also permitting the front pair of wheels to rotate fully around the axis 59 as shown at 62, provides substantial freedom of movement to a rider.

Figure 5B:
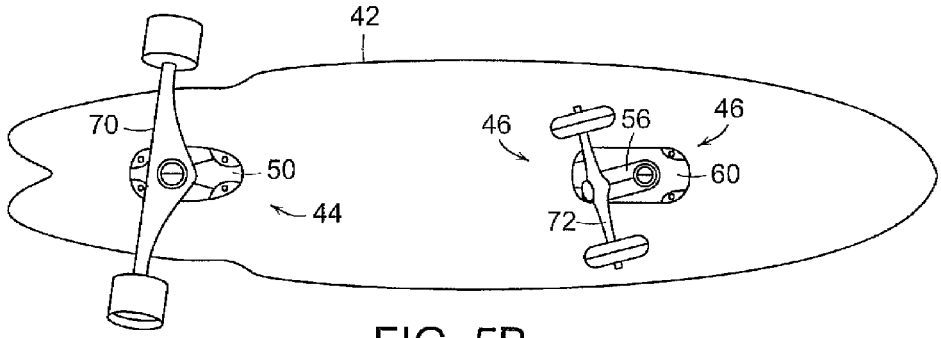
Figure 5C:
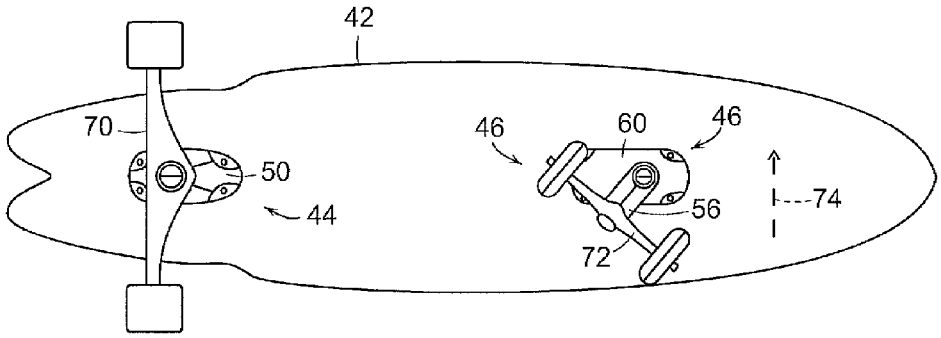

For example, FIGS. 5B and 5C show the skateboard 40 while turning to the right in two very different ways. First, in FIG. 5B, the board is tilted by applying pressure to the right side of the board 42 causing the rear wheels of the rear wheel assembly 44 to move along the plane 52 as discussed above with reference to FIGS. 3A and 4B. At the same time, the front wheels of the front wheel assembly 46 move both along the plane 58 and also rotate around the axis 59 as shown at 62 and 66 as discussed above with reference to FIGS. 3A and 4B.

In FIG. 5C, on the other hand, a turn to the right may also be accomplished without tilting of the board with respect to the ground. Instead, a force may be applied to the board (while the board remains level), such as by having the rider apply a right direction slid force on the top side of the board as generally shown at 74 while at the same time providing that the rear portion of the skateboard remains relatively stationary. This provides that a user may cause the skateboard to begin moving eventually in a forward direction from a dead stop without pushing off of the ground. Thereafter, the board may be self-propelled by side to side movement. Skateboards of the present embodiment provide substantial freedom of turning capabilities, and have been found to provide a unique riding experience due to the substantial freedom of stable movement of the front wheel assembly.

Figure 6A:
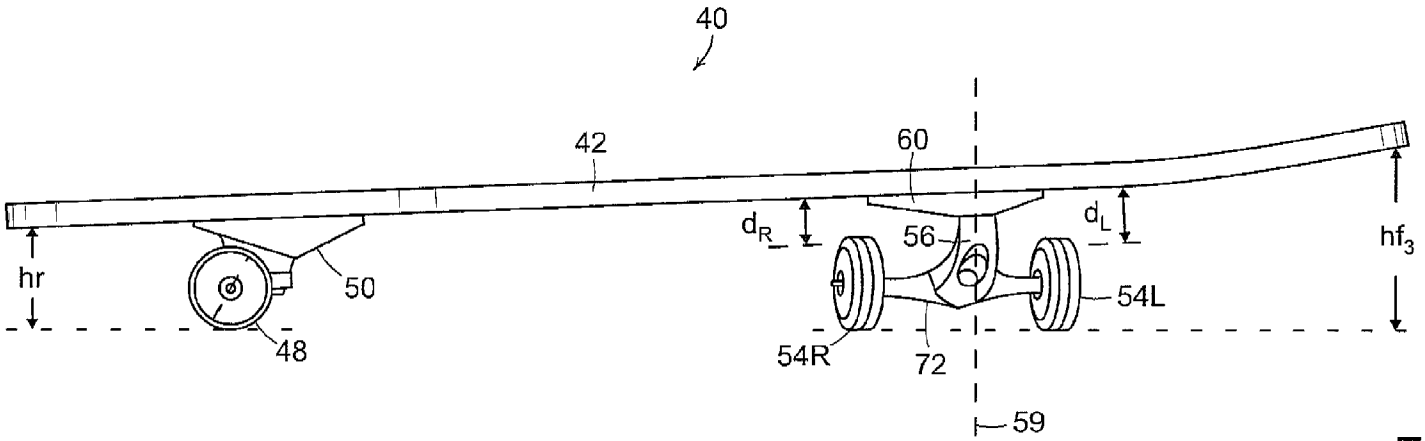
FIGS. 6A and 6B show illustrative diagrammatic side views of the skateboard of FIGS. 3A and 3B while turning left and right respectively without tilting of the board.
Figure 6B:
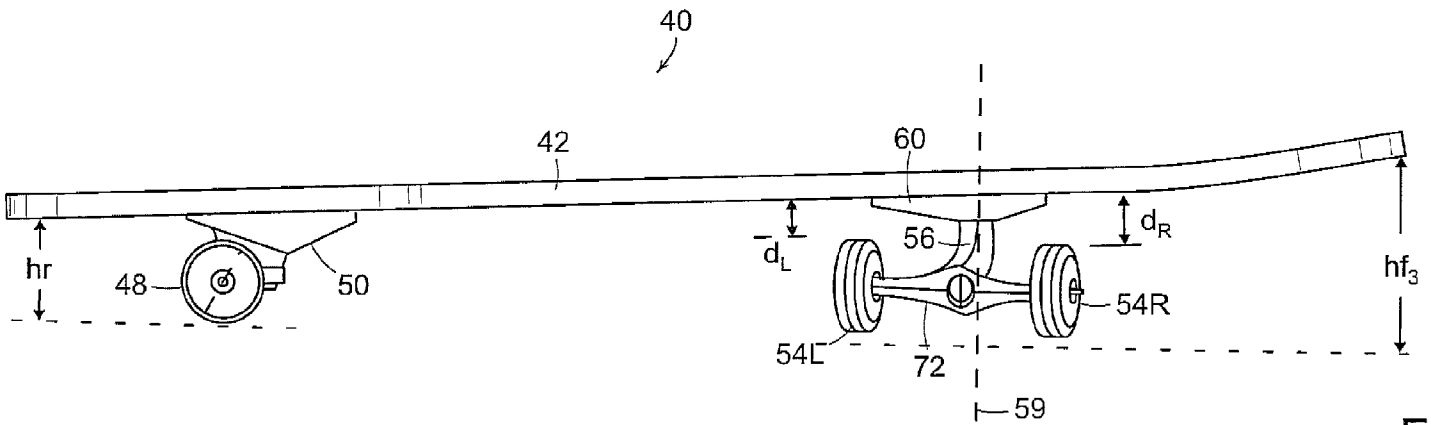

As further shown in FIGS. 6A and 6B for example, a skateboard of the present embodiment may be turned while the rear wheels remain relatively stationary yet the movement of the mid-truck about the axis 59 causes the board to turn responsive to the force 74 shown in FIG. 5C. FIG. 6A shows the skateboard turning right while the distances $d_R$ and $d_L$ of the right and left front wheels respectively from the underside of the board remain substantially the same. FIG. 6B shows the skateboard turning left while the distances $d_R$ and $d_L$ of the right and left front wheels respectively from the underside of the board also remain substantially the same.

Figure 7A:
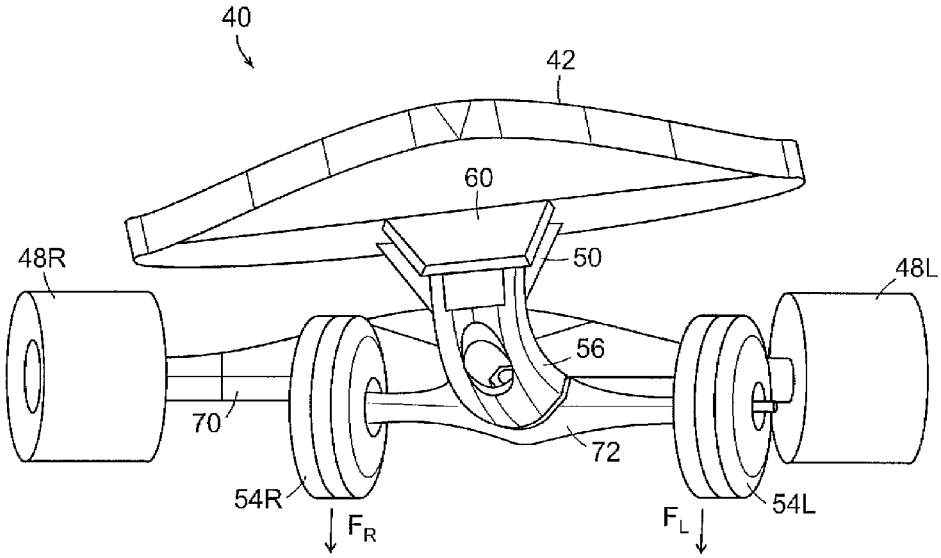
FIGS. 7A and 7B show illustrative front views of the skateboard of FIGS. 3A and 3B turning right and turning left in accordance with an embodiment of the invention.
Figure 7B:
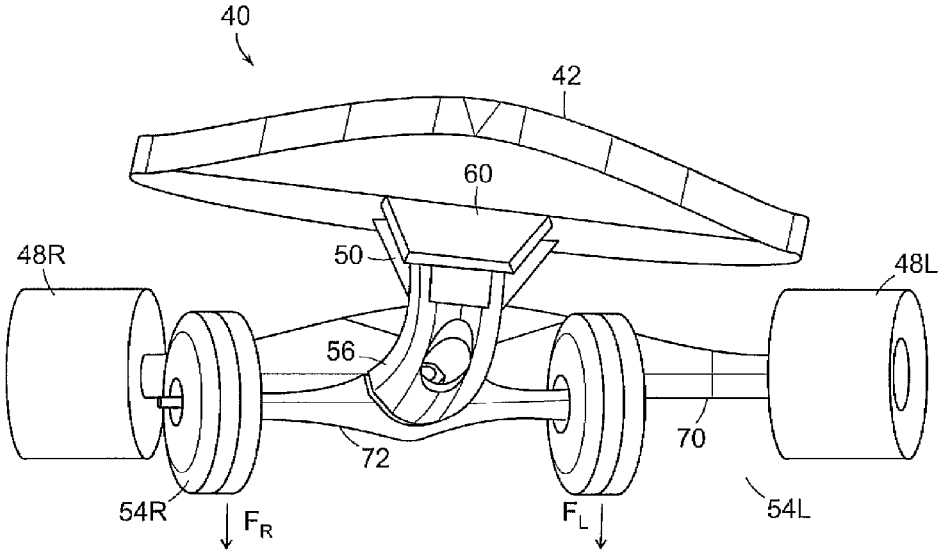
Figure 8:
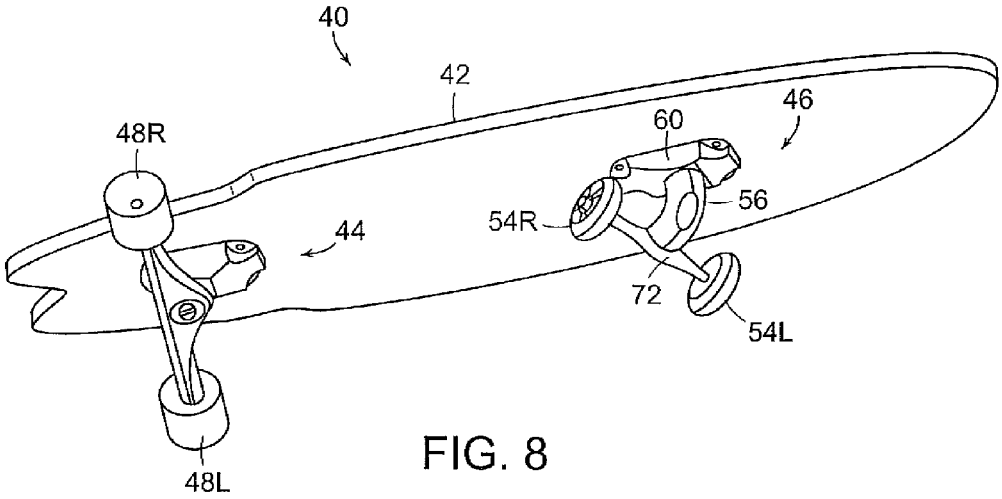
FIG. 8 shows an illustrative diagrammatic isometric view of the underside of the skateboard of FIGS. 3A and 3B turning to the left in accordance with an embodiment of the invention.

FIGS. 7A, 7B and 8 show examples of the dynamic movement of the front wheel assembly that includes the attachment base 60, the mid-truck 56, the front axle 72 and the front wheels 54R and 54L. In particular, FIG. 7A shows a front view of the skateboard 40 turning to the right (e.g., a front view of the skateboard as shown in FIG. 5B), and FIG. 7B shows a front view of the skateboard 40 turning to the left. The movement of the front wheel assembly also provides that the skateboard may be self-propelled when the rider rocks from left to right repeatedly. As shown in FIGS. 7A and 7B, when a user initiates a turn, the front axle 72 will rotate about the axis 59 (shown in FIGS. 3A, 3B, 6A and 6B) to cause the weight of the rider and the force exerted by the turn to be substantially evenly distributed between each of the front wheels. In particular, the force applied by wheel 54R (at the center of the wheel 54R) against the ground is shown at $F_R$, and the force applied by wheel 54L (at the center of the wheel 54L) against the ground is shown at $F_L$. This embodiment of the invention provides that $F_R=F_L$ for all turns of varying radii, even if the rear truck is not moving.

FIG. 8 shows an elevational isometric view of the skateboard 40 while turning to the right as discussed above with reference to FIG. 5C. Such a turn may be initiated by side force only as discussed above with reference to FIG. 5C. The continuous balancing of the load permits the skateboard to enjoy excellent tracking of the ground surface at all points during even aggressive turns. In particular, as a turning motion applies force to one side of the board, the front axle 72 may initially rotate about the axis 84 with respect to the mid-truck 56, but as the difference in force exerted by wheels 54L and 54R on the ground becomes significant, the axle 72 rotates with the mid-truck 56 with respect to the attachment base 60 so as to equalize the force exerted by each of the front wheels 54L and 54R on the ground. This facilitates providing a substantially smooth and stable ride with great freedom of movement of the skateboard.

Figure 9:
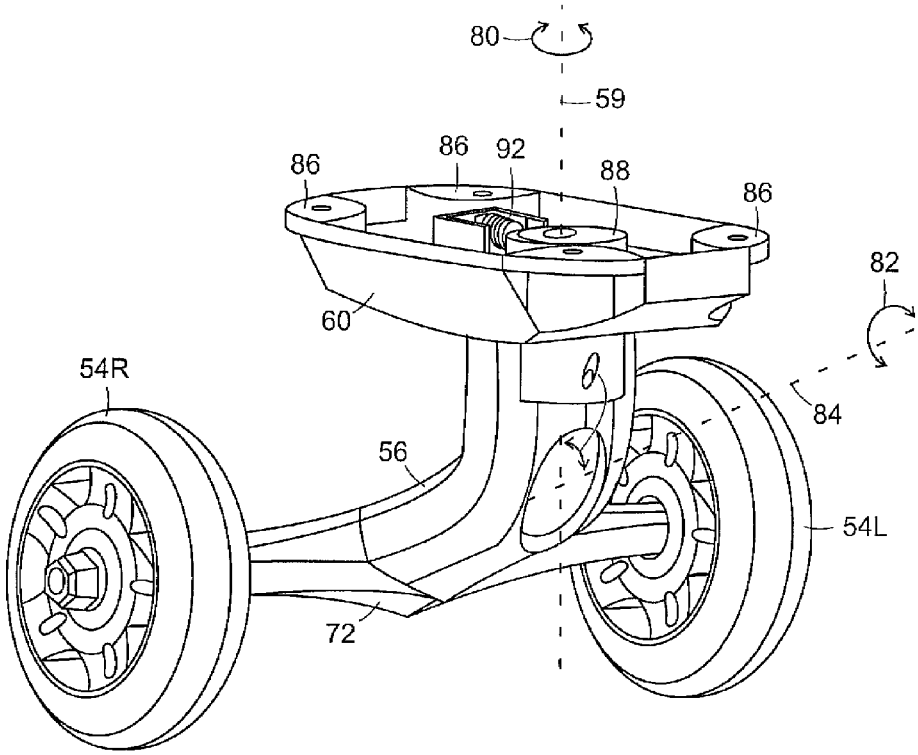
FIG. 9 shows an illustrative diagrammatic isometric view of the front wheel assembly of the skateboard of FIGS. 3A and 3B.

FIG. 9 shows an isometric view of the front wheel assembly 46 that includes the attachment base 60, the mid-truck 56, the front axle 72 and the wheels 54R and 54L. As shown at 80, the mid-truck 56 (together with the axle 72 and wheels 54R and 54L) are permitted to rotate fully with respect to the attachment base 60 along the axis 59. As shown at 82, the axle 72 together with the wheels 54R and 54L are permitted a limited range of rotation with respect to the mid-truck 56 along the axis 84. The axis 59 may pass through the board and may be substantially perpendicular to the board, and the angular difference θ between the axis 84 and the axis 59 may be, for example, approximately 70 degrees.

Figure 10A:
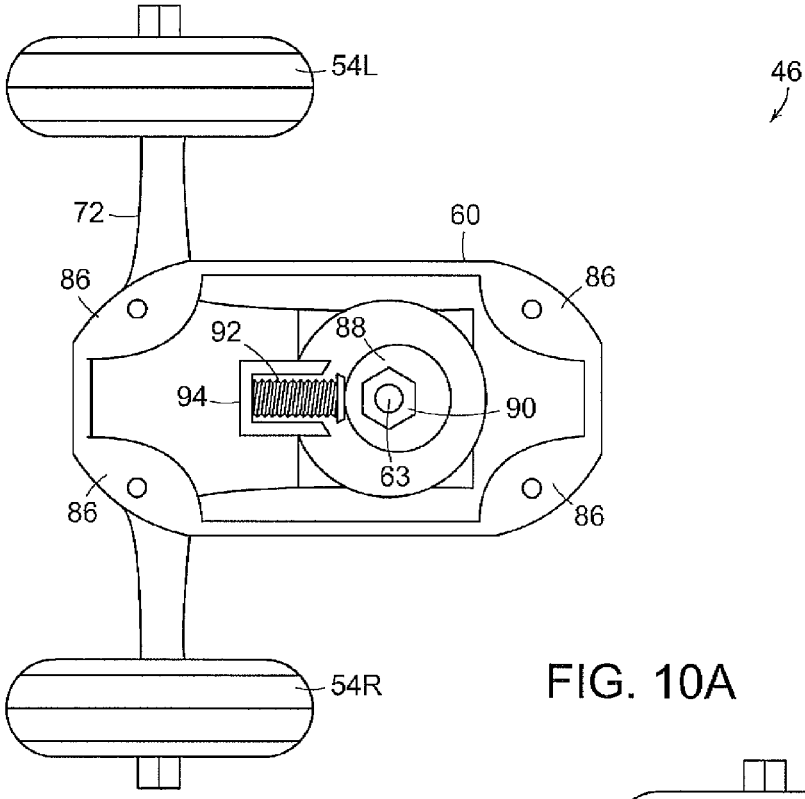
FIGS. 10A and 10B show illustrative diagrammatic top views of the front wheel assembly of the skateboard of FIGS. 3A and 3B in a forward facing direction (FIG. 10A) and in a rearward facing direction (FIG. 10B)
Figure 10B:
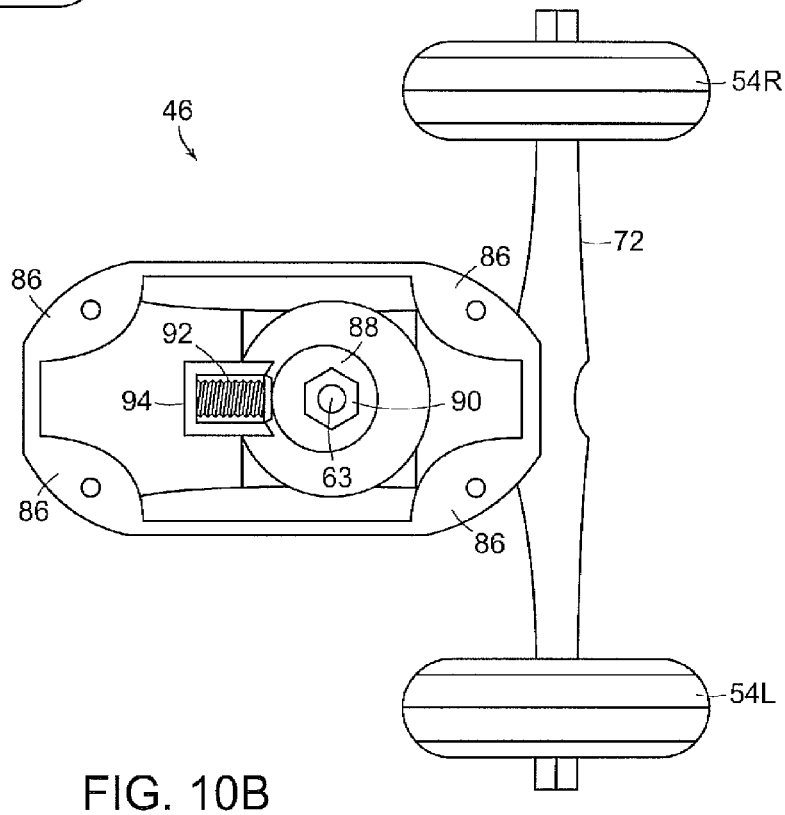

As further shown in FIGS. 10A and 10B, which show top views of the front wheel assembly 46 of FIG. 9 in forward and rearward facing directions, the attachment base 60 includes mounting portions 86 at which the attachment base is mounted to the underside of the board using, for example, screws (not shown). The mid-truck 56 is coupled to the attachment base 60 by a screw (the head 61 of which is visible in FIG. 5A and in FIG. 11) that extends into the attachment base 60. The end of the screw is visible at 63 in FIGS. 10A, 10B and 12.

Within the attachment base, a cam unit 88 is placed on the screw, and a nut 90 is employed to retain the screw yet permit the cam unit 88 to freely rotate together with the screw. In various embodiments, the cam 88 and screw may have mating alignment features (such as a post on the cam that engages a groove on the screw) to provide that the cam 88 rotates with the screw. Two nuts may be used as well to lock against each other so that the screw is maintained within the attachment unit 60 while permitting free rotation of the screw as is also well known in the art. The head 61 of the screw also preferably engages the body of the mid-truck 56 to ensure that they rotate together. In further embodiments, rivet pins may be employed instead of the screw and nut arrangement.

A spring 92 is also provided within a spring box 94 such that an application end of the spring 96 is applied to the cam unit 88. This arrangement provides a bias to the cam such that the spring is most relaxed when the smallest portion of the cam 88 is adjacent the spring end as shown in FIG. 10A. This provides the front wheel assembly 46 with a bias position wherein the front wheel assembly 46 is facing forward.

FIG. 10B shows the front wheel assembly 46 in the position where the mid-truck 56 (together with the cam 88) have rotated 180 degrees and now face rearward. This may occur during use, for example, if the rider travels backward. As soon as the force maintaining the rear facing position ceases, the front wheel assembly will swing around to return to the forward facing direction (as shown in FIG. 10A).

Figure 11A:
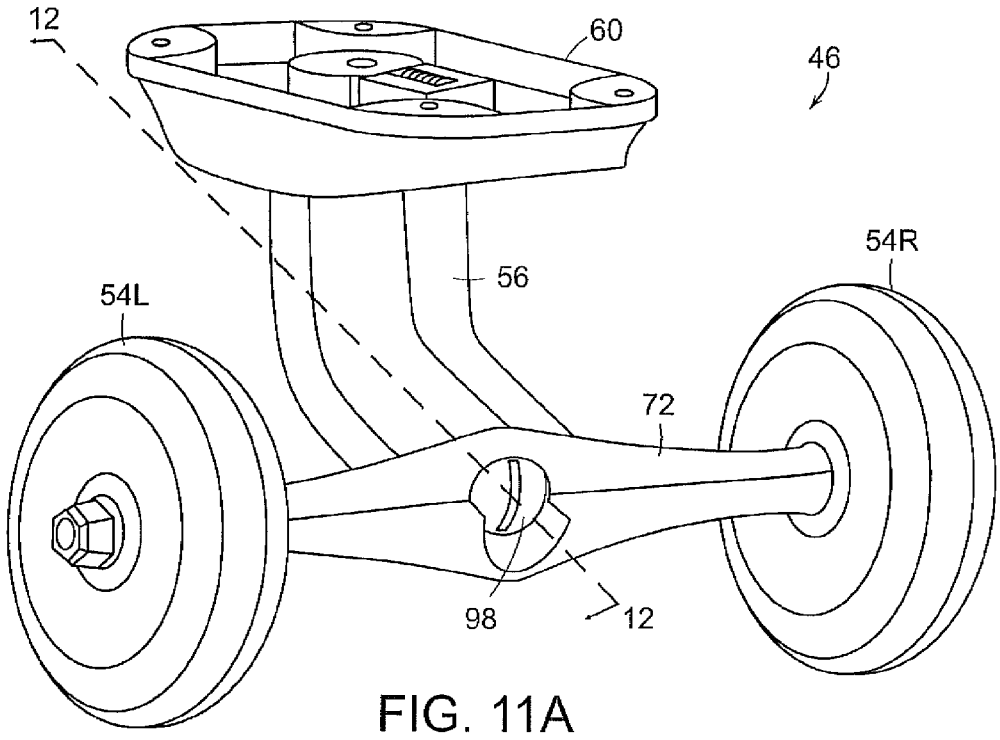
FIGS. 11A and 11B show illustrative diagrammatic isometric views of the front wheel assembly of the skateboard of FIGS. 3A and 3B without any rotational movement of the axle with respect to the mid-truck (FIG. 11A) and with movement of the axle with respect to the mid-truck (FIG. 11B)
Figure 11B:
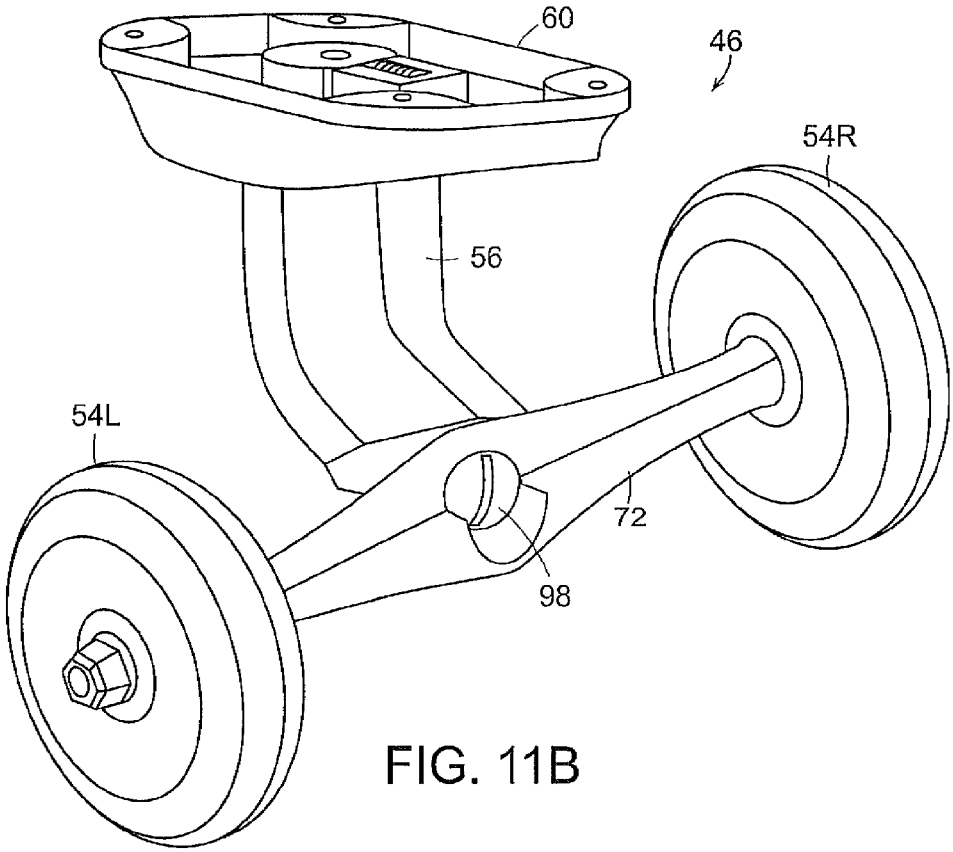
Figure 12:
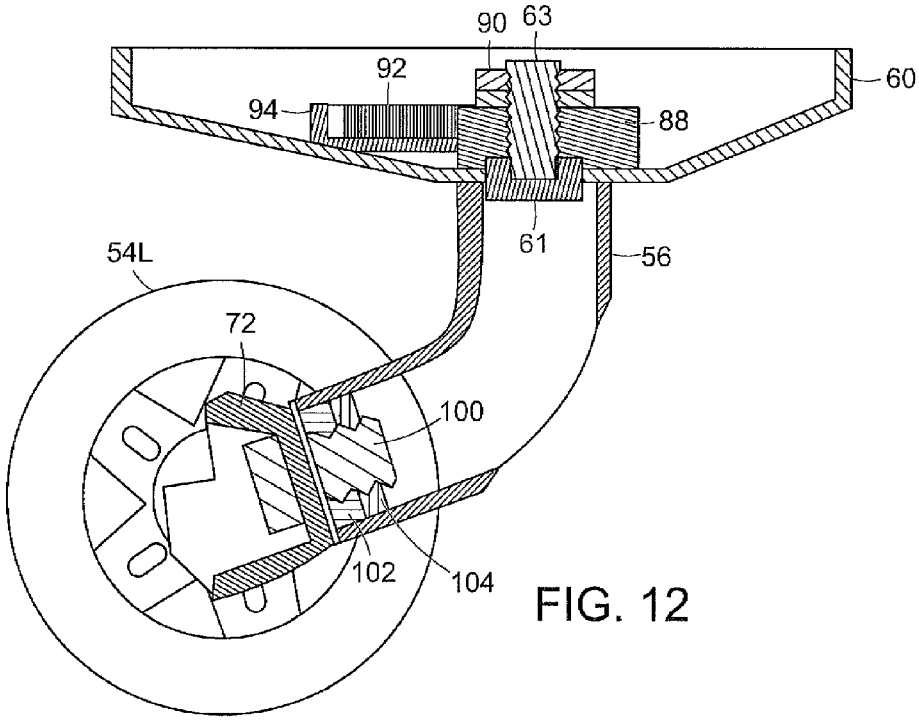
FIG. 12 shows an illustrative diagrammatic sectional view of the front wheel assembly of FIG. 11A taken along line 12-12 thereof.

As shown in FIGS. 11A and 11B, the axle 72 together with the front wheels 54L and 54R are mounted to provide limited rotation with respect to the mid-truck 56. As further shown in FIG. 12 (which is a sectional view of the front wheel assembly 46 shown in FIG. 11A), as well as FIG. 13 (which shows a front view of the front truck assembly 46), a screw having a head 98 rotatably attaches the axle 72 to the mid-truck 56 by engaging at the opposite end 100 thereof a pair of locking nuts 102, 104. The nuts 102, 104 may lock each other on the screw within the mid-truck 56 such that the screw (together with the axle 72 and wheels 54L and 54R) may be captured against the mid-truck 56 but may also be permitted to freely rotate with respect to the mid-truck 56. Again, in further embodiments, rivet pins may be employed instead of the screw and nut arrangement discussed above.

As shown in FIGS. 14A aid 14B, in accordance with further embodiments, the position of the front axle 172 with respect to the mid-truck 156 may be governed by springs 150 and 152 that together act to maintain the front axle 172 is a position (as shown in FIG. 14A) that is approximately parallel with the underside of the board. For example, as shown in FIG. 14B, when the axle 172 rotates during a right turn, the spring 150 becomes stretched and the spring 152 compresses. The combined action of both springs serve to bias the position of the axle 172 to return to the position as shown in FIG. 14A. Both rotational movements of the front wheel assembly 46, therefore, may have biased positions that quickly return the front wheel assembly 46 to a level, forward position when little or no force is not applied to the front wheel assembly 46. The springs 150 and 152 have also been found to provide a small amount of dampening of vibrations during riding.

Those skilled in the art will appreciate that numerous modifications and variations may be made to the above disclosed embodiments without departing from the spirit and scope of the present invention.

What is claimed is:

1. A skateboard comprising:

a rear wheel system that includes a pair of rear wheels that are mounted on a rear axle that is coupled to a rear truck that is attached to an underside of a rear portion of a board, said rear wheel system permitting each of the pair of rear wheels to alternately move toward a front portion of the board responsive to a force alternately urging each of the pair of rear wheels toward the underside of the board; and a front wheel system that includes a pair of front wheels that are mounted on a front axle that is rotatably attached to a mid-truck such that the front axle is movable about a first axis of rotation, said mid-truck being rotatably attached to an attachment base that is secured to an underside of the front portion of the board such that the mid-truck is rotatable about a second axis of rotation, the movement of the front axle about the first axis and the rotation of the mid-truck about the second axis during turning providing that each of the pair of front wheels bears substantially equal weight as the other of the pair of front wheels even when the rear truck is stationary with respect to the ground.

2. The skateboard as claimed in claim 1, wherein said second axis of rotation passes though the board and is substantially perpendicular to the board.

3. The skateboard as claimed in claim 2, wherein an angle between said first axis of rotation and said second axis of rotation is approximately 70 degrees.

4. The skateboard as claimed in claim 1, wherein said front wheels are mutually spaced apart from one another by a front wheel width distance, and said rear wheels are mutually spaced apart from one another by a rear wheel distance that is approximately twice the front wheel distance.

5. The skateboard as claimed in claim 1, wherein a height of a front end of the front portion of the board with respect to the ground is larger than a height of a rear end of the rear portion of the board with respect to the ground.

6. The skateboard as claimed in claim 1, wherein a distance between the underside of the front portion of the board and the pair of wheels changes automatically depending on the position of the mid-truck with respect to the attachment base.

7. The skateboard as claimed in claim 1, wherein said front wheel assembly includes first axis bias means for biasing the rotational position of the front axle with respect to the mid-truck about the first axis of rotation.

8. The skateboard as claimed in claim 1, wherein said front wheel assembly includes second axis bias means for biasing the rotational position of the mid-truck with respect to the attachment base about the second axis of rotation.

9. A skateboard comprising:

a rear wheel system that includes a pair of rear wheels that are mounted on either side of a rear truck base that is attached to an underside of a board, said rear truck base including a rear pivot assembly that permits each of the pair of rear wheels to alternately and oppositely move either forward with respect to the rear truck base and closer to the board, or rearward of the rear truck base and further from the board generally along a rear pivot plane; and a front wheel system that includes a pair of front wheels that are mounted on either side of a front mid-truck that is attached to the underside of the board by an attachment base that permits the front mid-truck together with the pair of front wheels to rotate in a full circle with respect to the attachment base about an axis of rotation such that the front wheels may rotate about the axis of rotation responsive to forces applied to the board to ensure that the centers of both wheels evenly distribute between them the force against the ground.

10. The skateboard as claimed in claim 9, wherein said front truck axis of rotation is generally perpendicular to the board.

11. The skateboard as claimed in claim 9, wherein said front wheel system includes forward facing bias means for biasing the position of the front mid-truck with respect to the board to be in a forward facing position, with a pivot point on the front truck being forward of the axis of rotation of the front wheels.

12. The skateboard as claimed in claim 11, wherein said forward facing bias means includes a cam mechanism within the attachment base.

13. The skateboard as claimed in claim 9, wherein said rear wheels are mutually spaced apart from one another by a rear wheel width distance, and said front wheels are mutually spaced apart from one another by a front wheel width distance that is smaller than the rear wheel width distance.

14. A skateboard comprising:

a rear wheel system that includes a pair of rear wheels that are mounted on either side of a rear truck base that is attached to an underside of a board, said rear truck base including a rear pivot assembly that permits each of the pair of rear wheels to alternately and oppositely move either forward with respect to the rear truck base and closer to the board, or rearward of the rear truck base and further from the board generally along a rear pivot plane; and a front wheel system that includes a pair of front wheels that are mounted on either side of a front mid-truck that is attached to the underside of the board via a rotating attachment base, said front wheel system providing that each of the pair of front wheels is mounted for movement alternately either closer to or further away from the underside of the board and that the attachment base permits the front mid-truck to rotate together in a full circle with respect to the attachment base, wherein an axle that is coupled to the pair of front wheels is not substantially aligned with an axis of rotation of the mid-truck.

15. The skateboard as claimed in claim 14, wherein the pair of front wheels is mounted for movement alternately either closer to or further away from the underside of the board by being mounted on a front axle that is rotatably coupled to the front mid truck, and wherein the position of the front axle with respect to the front mid-truck is biased in a position that provides that the front axle is generally parallel with the underside of the board.

16. The skateboard as claimed in claim 14, wherein said front wheel system further includes forward facing bias means for biasing the position of the front mid-truck in a forward facing position with respect to the attachment base.

17. The skateboard as claimed in claim 14, wherein said rear wheels are mutually spaced apart from one another by a rear wheel width distance, and said front wheels are mutually spaced apart from one another by a front wheel width distance that is approximately one half of the rear wheel width distance.

18. The skateboard as claimed in claim 14, wherein the skateboard includes a rear portion of the board and a front portion of the board, and wherein said rear portion has a rear portion height from a ground surface, and wherein said front portion has a front portion height from the ground surface that is larger than the rear portion height.

19. A method of using a skateboard comprising the steps of:

applying force to a first side of a skateboard, said skateboard having a front end and a rear end;

permitting a first of a pair of rear wheels to move forward with respect to a rear truck base and closer to the skateboard on the first side of the skateboard, and permitting a second of the pair of rear wheels to be moved rearward with respect to a rear truck base and further from the skateboard on an opposite second side of the skateboard;

permitting a first of a pair of front wheels to move forward with respect to a front truck base and closer to the skateboard on the first side of the skateboard, and permitting a second of the pair of front wheels to be moved rearward with respect to the front truck base and further from the skateboard on an opposite second side of the skateboard; and permitting the front mid-truck to rotate about a mid-truck axis of rotation with respect to the skateboard while the skateboard is turning toward the first side, the rotation of the mid-truck providing that the front end of the skateboard has a first height from a ground surface when the mid-truck is in a first position, and has a second height from the ground surface that is different than the first height when the mid-truck is in rotationally changed position.

20. The method as claimed in claim 19, wherein said method further includes the step of riding the skateboard in a backward direction, and permitting the front mid-truck to rotate with respect to the skateboard such that the position of the front mid-truck returns to a biased position in which the front mid-truck faces forward.

21. A skateboard comprising:

a rear wheel system that includes a pair of rear wheels that are mounted on a rear axle that is coupled to a rear truck that is attached to an underside of a rear portion of a board, said rear wheel system permitting each of the pair of rear wheels to alternately move toward a front portion of the board responsive to a force alternately urging each of the pair of rear wheels toward the underside of the board; and a front wheel system that includes a pair of front wheels that are mounted on a front axle that is rotatably attached to a mid-truck such that the front axle is movable about a first axis of rotation, said mid-truck being rotatably attached to an attachment base that is secured to an underside of the front portion of the board such that the mid-truck is rotatable about a second axis of rotation, the rotation of the mid-truck providing that a front end of the skateboard has a first height from a ground surface when the mid-truck is in a first position, and has a second height from the ground surface that is different than the first height when the mid-truck is in rotationally changed position.

22. The skateboard as claimed in claim 21, wherein said second axis of rotation passes though the board and is substantially perpendicular to the board.

23. The skateboard as claimed in claim 22, wherein an angle between said first axis of rotation and said second axis of rotation is approximately 70 degrees.

24. The skateboard as claimed in claim 21, wherein said front wheels are mutually spaced apart from one another by a front wheel width distance, and said rear wheels are mutually spaced apart from one another by a rear wheel distance that is approximately twice the front wheel distance.

25. The skateboard as claimed in claim 21, wherein said front wheel assembly includes first axis bias means for biasing the rotational position of the front axle with respect to the mid-truck about the first axis of rotation.

26. The skateboard as claimed in claim 21, wherein said front wheel assembly includes second axis bias means for biasing the rotational position of the mid-truck with respect to the attachment base about the second axis of rotation.

* * * * *

UNITED STATES PATENT AND TRADEMARK OFFICE

CERTIFICATE OF CORRECTION

PATENT NO. : 8,079,604 B2
APPLICATION NO. : 12/473695
DATED : December 20, 2011
INVENTOR(S) : Newton It is certified that error appears in the above-identified patent and that said Letters Patent is hereby corrected as shown below:

Please replace “mid-trick” with “mid-truck” in column 2, line 45.

Signed and Sealed this
Seventh Day of February, 2012

David J. Kappos

David J. Kappos
*Director of the United States Patent and Trademark Office*